US005851005A

United States Patent [19]

Muller et al.

[11] Patent Number: 5,851,005

[45] Date of Patent: Dec. 22, 1998

[54] ENERGY ABSORPTION APPARATUS

[76] Inventors: Franz M. Muller, Via Scheiwiller, 1, Milano 20133, Italy; Marco Anghileri, Via Zuretti, 47, Milano 20125, Italy

[21] Appl. No.: 843,392

[22] Filed: Apr. 15, 1997

[51] Int. Cl.[6] ..... E10F 15/04

[52] U.S. Cl. ..... 256/13.1; 404/6

[58] Field of Search ..... 256/13.1; 404/6, 404/9

[56] References Cited

U.S. PATENT DOCUMENTS

| | | | |
|---|---|---|---|
| 2,091,195 | 8/1937 | Dennebaum | 256/13.1 X |
| 3,643,924 | 2/1972 | Fitch | 256/13.1 |
| 3,674,115 | 7/1972 | Young et al. | 256/13.1 X |
| 3,845,936 | 11/1974 | Boedecker, Jr. et al. | 256/13.1 X |
| 3,982,734 | 9/1976 | Walker | 256/13.1 |
| 4,352,484 | 10/1982 | Gertz et al. | 256/13.1 |
| 4,638,979 | 1/1987 | Demarest | 256/13.1 |
| 4,674,911 | 6/1987 | Gertz | 404/6 |
| 5,011,326 | 4/1991 | Carney, III | 404/6 |
| 5,078,366 | 1/1992 | Sicking et al. | 256/13.1 |
| 5,112,028 | 5/1992 | Laturner | 256/13.1 |
| 5,125,762 | 6/1992 | Strassil | 404/6 |
| 5,192,157 | 3/1993 | Laturner | 404/6 |
| 5,391,016 | 2/1995 | Ivey et al. | 404/6 |
| 5,660,496 | 8/1997 | Muller et al. | 256/13.1 X |

FOREIGN PATENT DOCUMENTS

| | | | |
|---|---|---|---|
| 0042645 | 12/1981 | European Pat. Off. . | |
| 432573 | 9/1967 | Switzerland | 256/13.1 |
| 4131937 | 4/1993 | United Kingdom | 256/13.1 |
| WO94/05527 | 3/1994 | WIPO . | |

*Primary Examiner*—Anthony Knight
*Attorney, Agent, or Firm*—Harpman & Harpman

[57] ABSTRACT

An energy absorption apparatus to dissipate impact force of a vehicle and to protect fixed objects near highway by safely stopping the vehicle. A plurality of energy absorbing metal plates are configured in such a way that by applying the force of impact of a vehicle that they successfully collapse absorbing the impact forces.

7 Claims, 5 Drawing Sheets

ENERGY ABSORPTION APPARATUS

BACKGROUND OF THE INVENTION

1. Technical Field

This device relates to apparatus barriers that are used to absorb and dissipate the impact energy of moving vehicles upon impact. More specifically the device relates to energy absorbing structures that have multiple deformable devices within that successfully absorb the impact of vehicles without traumatic injury to the occupants and damage to the structure which the barrier protects.

2. Description of Prior Art

As it is know, urban and country roads usually comprise numerous dangerous zones where there are rigid obstacles such as pillar bridge abutments, paraphets, and lighting poles and the like. In order to prevent an impact against these obstacles from causing serious damage to the occupants of an impacting vehicle, there are conventionally provided impact absorbing systems generally called "crash cushions", specifically designed for absorbing the vehicle impact energy so as to decrease the speed of the vehicle thereby reducing the effects of impact on the vehicle occupants.

Since the danger for these occupants is mainly due to the de-acceleration rate, it is particularly important that such crash cushions give a constant performance in different speed conditions and specifically a constant force as response to the impact force.

The constant response force is the ideal case where the length of the device is minimized and the safety requirements are optimized. This force results from a compromise since it should be high enough to stop the heaviest car usually having a mass of 2,000 kgs and low enough to stop the smallest car usually having a mass of 900 kgs, for example, without generating excessive acceleration on the occupants.

Prior art impact dissipation devices are well known based on a variety of different momentum transfer concepts, see for example U.S. Pat. Nos. 3,643,924, 3,674,115, 3,845,936, 3,982,734, 4,352,484, 4,674,911, 5,011,326, 5,078,366, 5,125,762, 5,192,157, 5,391,016 and European patent application Ser. No. 81200664.1 and PCT application W094/05527 for a liquid, sand or air are used as crushable and deformable materials together with plastic deformation of rigid materials such as steel and the like. Additionally, other energy absorbing materials are used such as rigid plastic foam, aluminum pipes or combinations of same.

SUMMARY OF THE INVENTION

An energy absorbing barrier to provide improved impact attenuation using the plastic deformation principal which defines an easy and convenient way to absorb energy. This principal can be manipulated to get the required linear force response with the use of commonly available materials that are recyclable after impact.

This was achieved by studying a particular configuration of a metal plate, the metal being steel or aluminum or any other which can show a ductile behavior and therefore show a curve stress/strain with a top part after yield point as an arc of large radius in such a way to deliver an approximately constant force which is the ideal characteristic for an energy absorber.

It has been discovered after studies and tests that a plate of suitable thickness shaped to a diamond or superior polygon, compressed on vertexes delivers such performance.

DESCRIPTION OF THE PREFERRED EMBODIMENT

Figures 1, 1A:
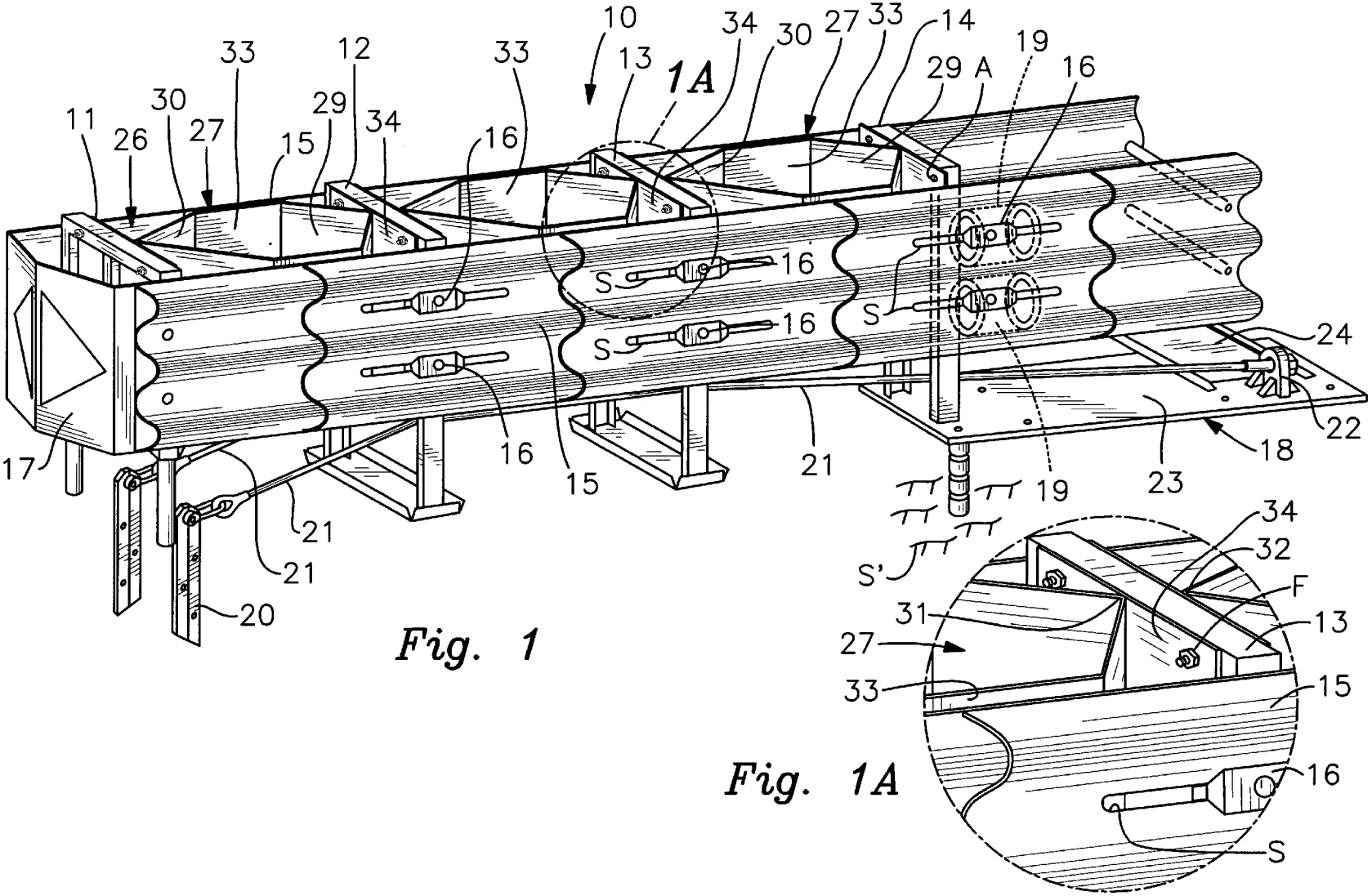
FIG. 1 is a perspective view of the energy absorbing device of the invention.
FIG. 1A is an enlarged perspective view of a portion of FIG. 1.

Referring to FIG. 1 of the drawings, a modular energy absorption barrier assembly 10 can be seen having multiple pairs of ground engaging support uprights 11–14 interconnected to one another by overlapping side panels 15 which are preferably of a typical corrugation guard rail configuration well known to those skilled in the art and are secured to the aforementioned uprights 11–14 by interengaging slides 16 fixed to the uprights by fasteners sliding in longitudinal slots S formed in the respective side panels 15.

A front impact element 17 is secured to the respective side panels 15 adjacent the front pair of support uprights 11. A rear anchor support 18 is anchored to the soil S and defines the anchor point of the system. The rear anchor support 18 has deformable side spacer elements 19 to control side impact at this point.

Figure 9:
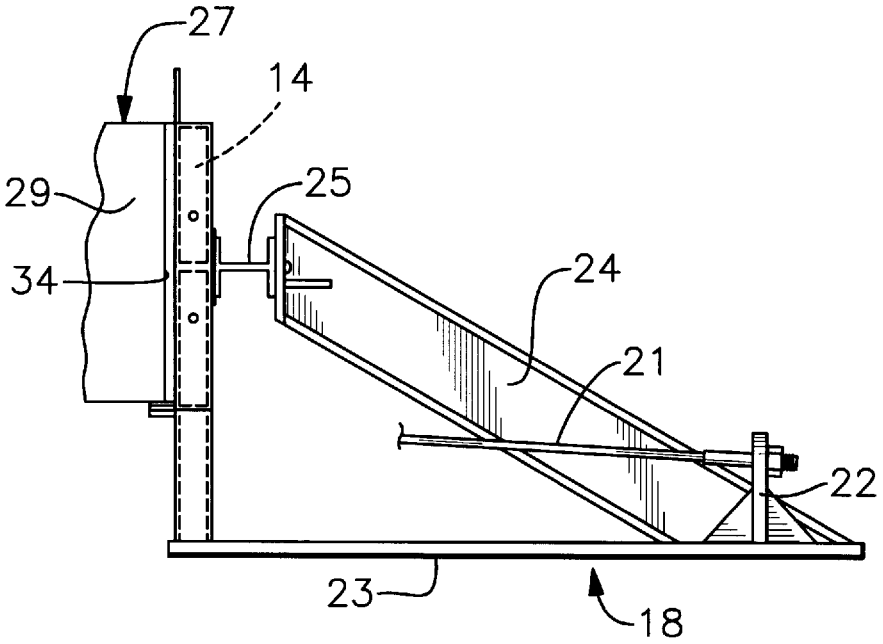
FIG. 9 is a side elevation of the rear anchor with portions broken away.
Figure 10:
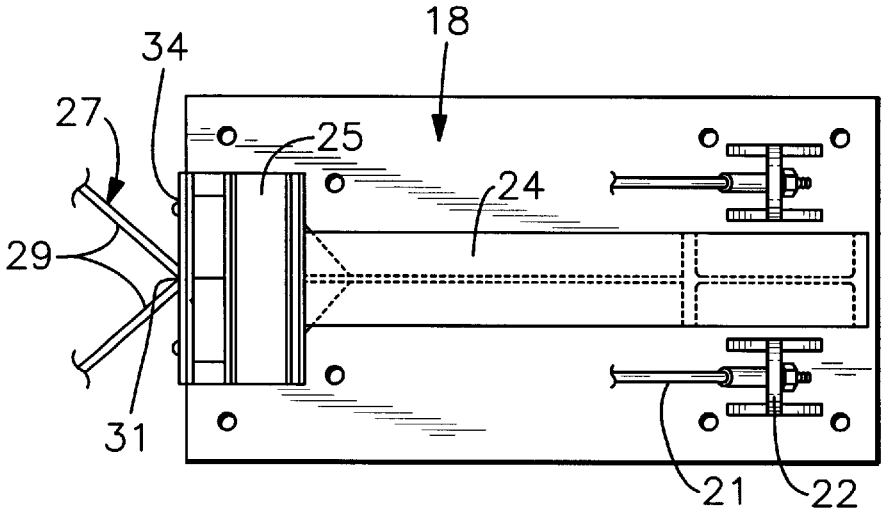
FIG. 10 is a top plan view of the rear anchor illustrated in FIG. 9.
Figure 11:
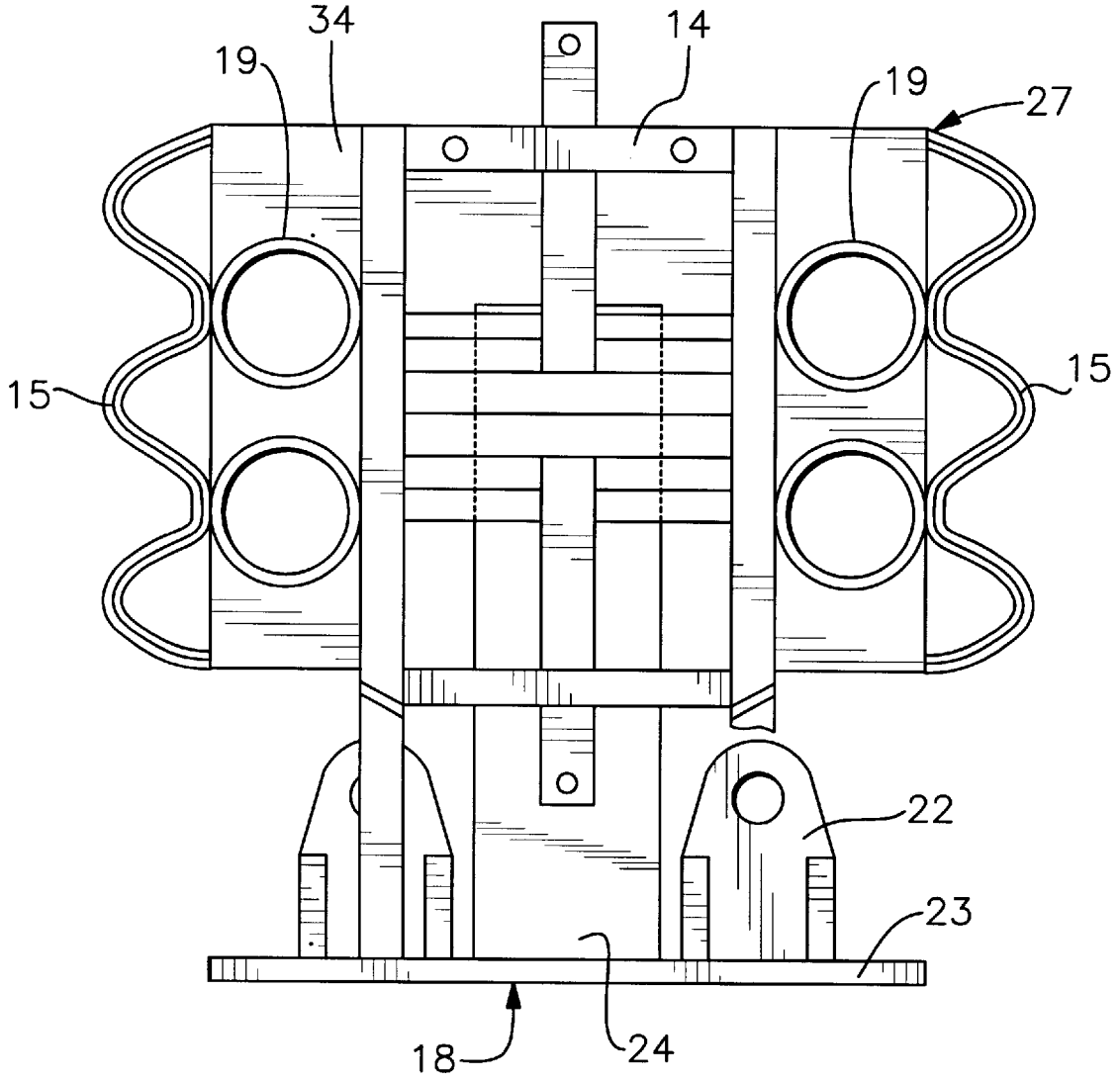
FIG. 11 is an end view of the rear anchor shown in FIG. 9.

A pair of soil engagement anchor posts 20 with pre-stress cables 21 extending therefrom secures the barrier to the ground as is typical within the art. The cables 21 are connected to cable retention brackets 22 on a base plate 23 of the rear anchor support 18 which has an inclined I-beam 24 extending therefrom as best illustrated in FIGS. 9 and 10 of the drawings. The inclined I-beam 24 is engageable with an intermediate I-beam 25 and provides the additional advantage by plastic deformation in the case of impact that is greater than that of the designed impact energy of the system as will be hereinafter described in greater detail.

The multiple pairs of support uprights 11–14 are in longitudinally spaced relation to one another between the respective side panels 15 defining energy absorbing compartments 26 therebetween.

The energy absorbing barrier assembly 10 thus described is constructed according to the criteria set forth in U.S. patent application Ser. No. 503,729 (Muller et al) and therefore further delineation and explanation of the structure illustrated therein is not required.

Figure 2:
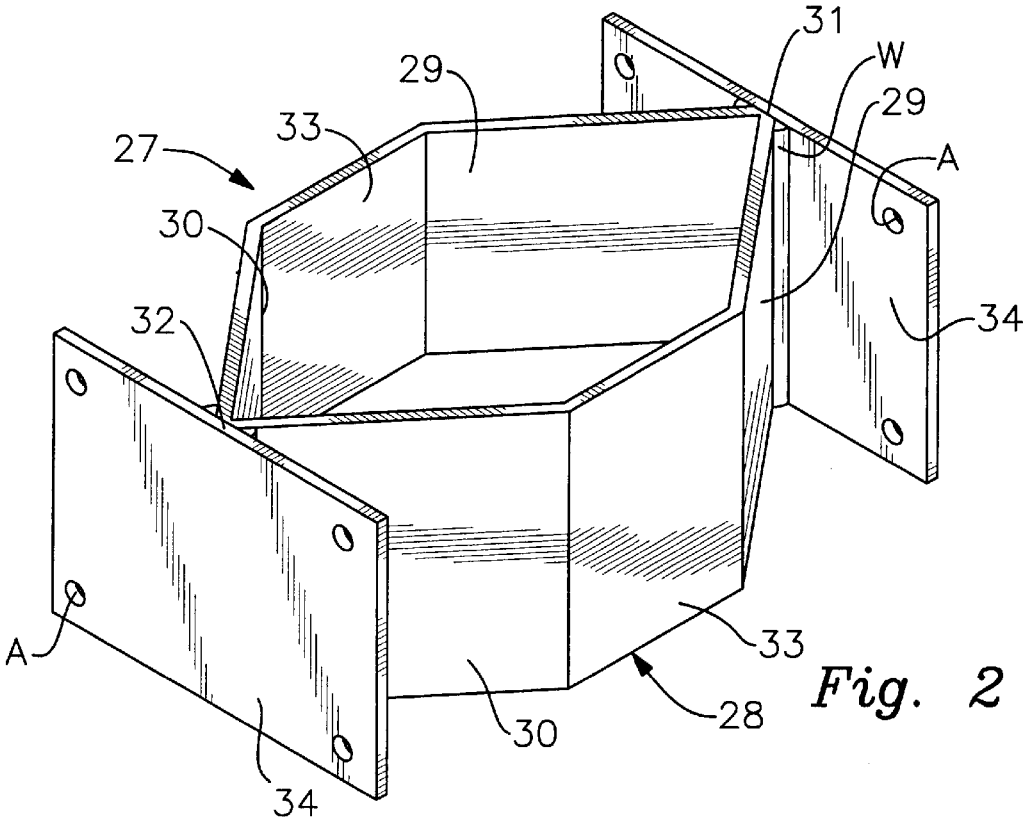
FIG. 2 is a perspective view of the configured impact plate of the invention.
Figure 3:
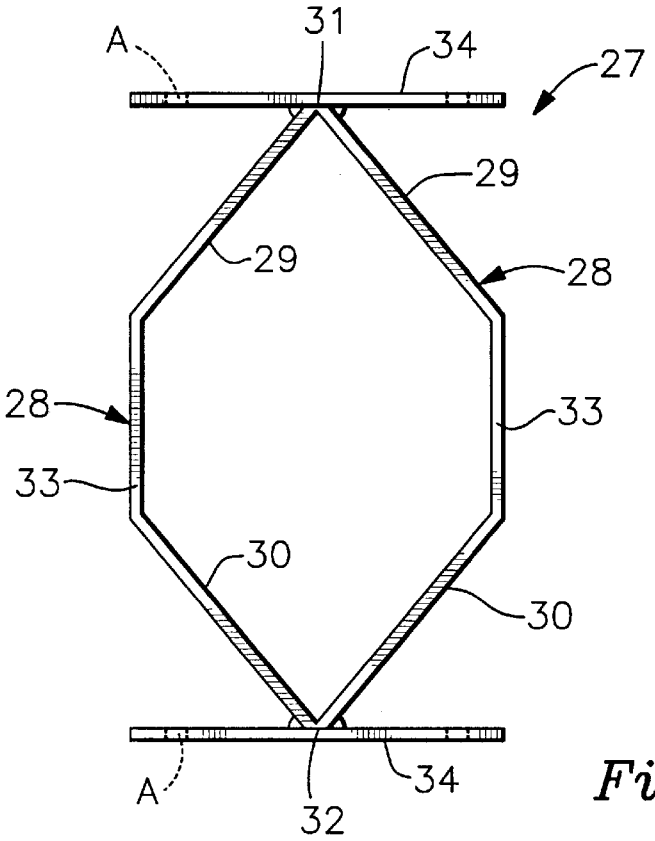
FIG. 3 is a top plan view of the configured impact plate shown in FIG. 2.
Figure 4:
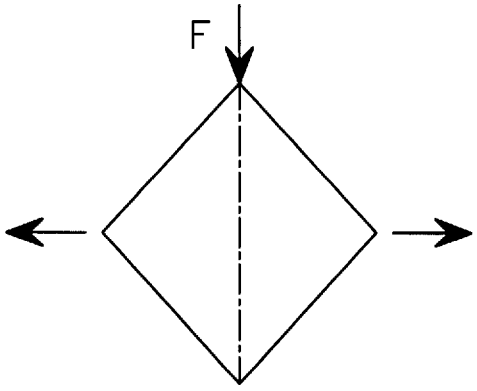
FIG. 4 is a theoretical graphic representation of a part of a diamond squashed on its top vertex.
Figure 5:
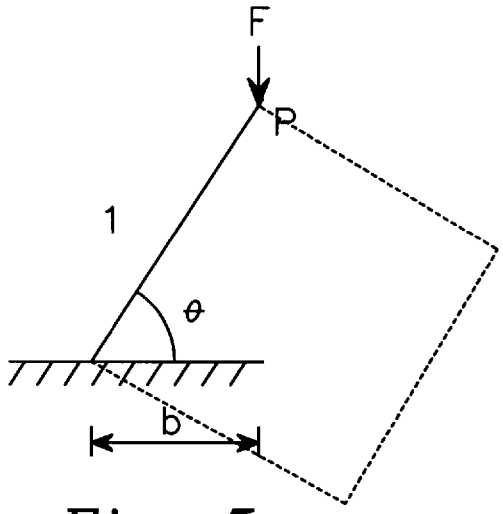
FIG. 5 is a schematically arranged illustration of the diamond shape as a beam fixed at one end illustrating applied load forces.

The present invention sets forth an improved means for energy absorption within the defined energy absorbing compartments 26 of the barrier assembly 10 and that the present invention is directed to an energy dissipation plate assembly 27, best seen in FIGS. 2, 3, and 4 of the drawings.

The energy dissipation plate assembly 27 defines a hexagon shape by coupling two identically shaped elements 28 together. Each of the shaped elements 28 is obtained by bending an initially flat rectangular metal shape into multiple angular offset angles 29 and 30 in spaced relation to one another adjacent its respective free ends 31 and 32 with an intermediate portion 33 left therebetween. The pair of the shaped elements 28 are joined together in abutting relationship at their respective ends 31–32 by engagement to bearing flanges 34 by welding thereto, that have a plurality of mounting apertures A therein.

The assembled energy dissipation plates 27 are positioned respectively within the energy absorbing compartments 26 by a plurality of fasteners F to the respective support pairs 11–14 in the barrier assembly 10.

It will be apparent to those skilled in the art that the plates 27 can also be fabricated out of a plurality of thin milled plates to achieve the same structural result.

The energy dissipation plates 27 provide an improved energy absorbing structure when used in multiple units so that they are sequentially engaged by the impact of a vehicle against the barrier assembly 10 (not shown).

Referring now to FIGS. 4–8 of the drawings, a supporting theoretical demonstration is illustrated wherein basic structural form of the assembled energy dissipation plates is illustrated as part of a diamond squashed on its top vertex (see FIGS. 4 and 5 of the drawings) and arranged schematically as a beam fixed at the bottom end loaded with force F applied to the top point P.

Therefore the maximum moment in the fixing point; $M=F/b=F/1 \cos \theta$.

Point P starts to move sensibly at yield, i.e. when applied force F reaches yield point; $F_y=M_y/b$ and $M_y=\sigma_y w$; where w=modulus of the section $\sigma_y$=yield stress (variable during the application of the force).

Figure 6:
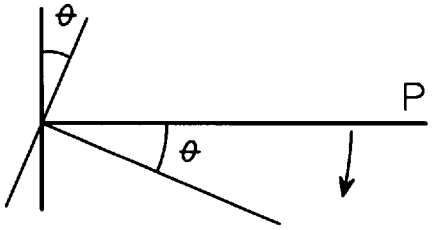
FIG. 6 is a schematically arranged illustration of a flexural deformation in the fixing point.
Figure 7:
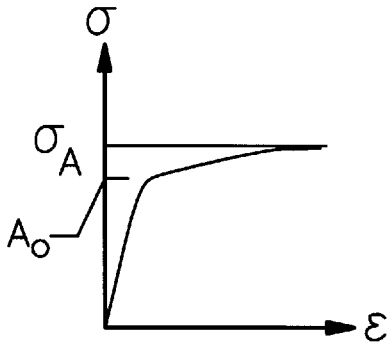
FIG. 7 is a graphic representation for a ductile material.

Referring now to FIG. 6 of the drawings, we consider now the flexural deformation of the fixing point for sensible movement of the point P, being t=thickness of the beam; $\epsilon=t/2 \sin \theta/2$ and the typical diagram $\sigma/\epsilon$ for a ductile material is represented in FIG. 7 where $A_o$=is the yield point stress.

We can approximate the top part of the diagram as $o=A_o+A \sin \epsilon$, where A=work hardening.

Therefore:

$$\sigma_y=A_o+A \sin (t/2 \sin \theta/2)$$

and $$F_y=(w/l \cos \theta)\ \sigma_y=w/l\ ((A_o+A \sin (t/2 \sin \Theta/2))/\cos \theta).$$

If we give now "representative" values for standard steel to $A_o$, A and t: $A_o$=40 kg/mm$^2$;A=15 kg/mm$^2$;t=15 mm neglecting constant term w/l, we have;

0=45 40 35 30 25 20 15 10 5 0

$F_y$=41 40.5 40.7 40.6 40.5 40.4 40.2 40.2 40.1 40

Figure 8:
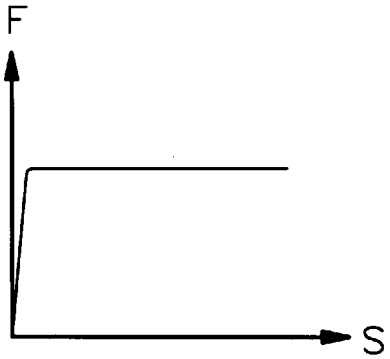
FIG. 8 is a graphic illustration of the displacement of the opposing forces.

As a conclusion, during the movement, the yield force $F_y$ can be considered constant and the diagram F/s is represented in FIG. 8 as being the displacement of the applied force F.

In operation, upon a front impact of the vehicle (not shown) the cables 21 operate to control the displacement of the barrier 10 while substantially holding barrier shape constant and providing a comparatively small resilient deformation in the case of a side impact. It will be apparent from the above description that as the vehicle impacts the front of the plate 4 of the barrier 10, the side panels 15 telescopically collapse linearly and simultaneously the energy dissipation plates 27 absorb energy as they are collapsed successively as the impact event continues, the overall de-acceleration of the vehicle is achieved and the minimization of acceleration of the vehicle's occupants is evident so that by the sequential crushing of the energy dissipation plates 27 the effective end result is achieved.

It will be apparent to those skilled in the art that the shaped elements 28 can be formed from multiple plate members of reduced thickness that when combined in multiple packets will emulate the given thickness of the hereinbefore described shaped elements 28 and 34 respectively.

It will thus be seen that an improvement to a crash barrier has been illustrated and described wherein a new and novel energy dissipation plate has been illustrated and described and it will be apparent to those skilled in the art that various changes and modifications may be made therein without departing from the spirit of the invention.

Therefore I claim:

1. An energy absorption barrier for rigid road side obstacles to dissipate kinetic energy imparted by a vehicle impact comprises; a ductile metal plate having a hexagon polygon shape, said hexagon polygon shape having two identical pairs of equal length intersecting elements defining oppositely disposed aligned vertexes interconnected by spaced parallel identical intermediate portions therebetween, wherein said metal plate is positioned within said energy absorption barrier so as to be compressed under impact on at least one vertex of said hexagon polygon, and means for mounting said metal plate within said energy absorption barrier.

2. The energy absorption barrier of claim 1 wherein said metal plate is formed from a pair of identical shaped elements secured together at the respective ends.

3. The energy absorption barrier of claim 1 wherein said mounting means comprises; bearing flanges secured to said respective free ends of said metal plate.

4. The energy absorption barrier of claim 1 wherein said metal plate is formed of a milled pack of multiple plates.

5. The energy absorption barrier of claim 1 wherein a plurality of metal plates are arranged in end to end spaced linear alignment within said energy absorption barrier.

6. The energy absorption barrier of claim 1 wherein said metal is steel.

7. The energy absorption barrier of claim 1 wherein said metal is aluminum.

* * * * *